US005913417A

United States Patent [19]

Ovadia

[11] Patent Number: 5,913,417

[45] Date of Patent: Jun. 22, 1999

[54] JEWELRY PADS HAVING RECESSES, PROJECTIONS AND/OR PLUGS FOR HOLDING JEWELRY ITEMS

[76] Inventor: Joseph Ovadia, 109 Long Hill Rd., Little Falls, N.J. 07424

[ * ] Notice: This patent issued on a continued prosecution application filed under 37 CFR 1.53(d), and is subject to the twenty year patent term provisions of 35 U.S.C. 154(a)(2).

[21] Appl. No.: 08/792,767

[22] Filed: Feb. 3, 1997

Related U.S. Application Data

[62] Division of application No. 08/465,142, Jun. 5, 1995, abandoned.

[51] Int. Cl.[6] ..... A45C 11/04

[52] U.S. Cl. ..... 206/6.1; 206/566

[58] Field of Search ..... 206/6.1, 562–566, 206/756, 765, 495; D9/341; 211/85.2

[56] References Cited

U.S. PATENT DOCUMENTS

| | | | |
|---|---|---|---|
| D. 318,985 | 8/1991 | Szablak et al. | D9/341 |
| D. 320,909 | 10/1991 | Szablak et al. | D9/341 |
| 1,681,092 | 8/1928 | Bulova . | |
| 1,907,681 | 5/1933 | Sundee . | |
| 2,119,832 | 6/1938 | Schless | 206/566 |
| 2,963,149 | 12/1960 | Bergh et al. . | |
| 3,197,166 | 7/1965 | Sandler . | |
| 3,206,014 | 9/1965 | Blumberg . | |
| 3,370,702 | 2/1968 | Rosen . | |
| 3,532,209 | 10/1970 | Del Bonis | 206/6.1 |
| 3,613,873 | 10/1971 | Schulman . | |
| 4,282,975 | 8/1981 | Ovadia . | |
| 4,311,235 | 1/1982 | Titus | 206/566 |
| 4,432,456 | 2/1984 | Ovadia . | |
| 4,848,585 | 7/1989 | Snyder . | |
| 4,887,709 | 12/1989 | Shimamine | 206/6.1 |
| 4,917,235 | 4/1990 | Feiler . | |
| 4,978,001 | 12/1990 | Nelson | 206/6.1 |
| 5,062,526 | 11/1991 | Rudnick et al. . | |
| 5,197,596 | 3/1993 | Garganese . | |
| 5,219,071 | 6/1993 | Knapp | 206/6.1 |
| 5,273,153 | 12/1993 | Braun . | |
| 5,273,154 | 12/1993 | Braun . | |
| 5,285,896 | 2/1994 | Salatka et al. | 206/562 |
| 5,316,153 | 5/1994 | Crawford et al. . | |
| 5,394,983 | 3/1995 | Latulippe et al. | 206/562 |
| 5,538,134 | 7/1996 | Pitesky | 206/562 |
| 5,547,072 | 8/1996 | Kaiser | 206/765 |

FOREIGN PATENT DOCUMENTS

| | | |
|---|---|---|
| 3938558 | 12/1990 | Germany . |

*Primary Examiner*—Paul T. Sewell
*Assistant Examiner*—Luan K. Bui
*Attorney, Agent, or Firm*—Richard M. Goldberg

[57] ABSTRACT

A jewelry pad for holding jewelry items, is formed from a deformable and resilient material of a substantially constant thickness throughout, and includes an upper wall having an upper exposed surface; opposite side walls and a rear wall connected with the upper wall for supporting the upper wall on a surface, the upper and rear walls each having a rectangular configuration and the side walls having substantially triangular configurations, such that the upper wall is inclined; and at least one projection extending upwardly from and formed integrally with the upper wall for holding a jewelry item thereon.

9 Claims, 3 Drawing Sheets

JEWELRY PADS HAVING RECESSES, PROJECTIONS AND/OR PLUGS FOR HOLDING JEWELRY ITEMS

This application is a division of application Ser. No. 08/465,142 filed Jun. 5, 1995, now abandoned.

BACKGROUND OF THE INVENTION

The present invention relates generally to display and storage devices, and more particularly, is directed to jewelry pads for storing and displaying items of jewelry.

In the past, jewelry has been displayed on pads in trays. The pads have been made from plastic, cardboard or foam rubber, and are usually covered with some kind of fabric or flocking to give a plush look for the aesthetic demands of jewelry display, with a layer of foam under the flocking or fabric.

However, these various pads have basic drawbacks. Specifically, plastic and cardboard pads tend to fall out of the trays, while foam rubber pads eventually lost memory from long term pressure. All of these pads became marred, dirty, ugly and eventually have to be replaced.

In the past, jewelry was attached to these pads in the following ways. Post earrings required that a hole be produced in the pad (either in production or by the end user). The earring back would then have to be removed from the earring. The pad would have to be removed from the tray and the earring inserted through the hole in the pad, and thereafter, the back of the earring replaced on the earring behind the pad. Then, the pad with the jewelry could be returned to the tray.

Clip and omega back earrings required a special flap for earrings to be clipped onto it. This required a special tray and post earrings could not be displayed on the same tray as clip earrings. Alternatively, cut-outs in a cardboard or plastic pad would allow the earrings to clip onto the pad in the same tray as the clip earrings, but this added to the cost of labor and detracted greatly from the aesthetic appeal of the presentation.

Pendants and charms have been attached to the above described pads using a separate device, namely, a wire twist pin or unshaped pin. This, however, posed many problems. First, the jewelry was difficult to center on the pad, that is, knowing where to stick the pin. Secondly, removing and replacing the pins to show the jewelry to customers soon ruined the surface of the pad. Third, it is very time consuming to place the jewelry on a pin, and then place the pin on the pad to display the jewelry, while performing the reverse order for removing the jewelry for a customer. This may be performed a dozen times in one day for just one item of jewelry on one pad in a busy store. The disadvantages here are tremendous (not to mention the bloody finger tips and ruined manicures these pins cause daily).

With the above in mind, a conventional jewelry tray includes a plurality of, for example, twelve, shallow closed-bottom recesses, with a cushioned pad held in each recess, each cushioned pad being adapted to hold a jewelry item. For example, in one instance, the posts of earrings or the like can be inserted through the pads with the posts being held at the bottom of the pads by earring backs.

However, this is disadvantageous for a number of reasons. First, in order to remove the earring, it is necessary to remove the pad from the tray, and then remove the earring back. This becomes time-consuming at the point of sale, particularly when a customer is trying on numerous pairs of earrings. Second, the posts of the earrings generally must puncture the pads in order to be inserted therethrough. This sometimes is difficult, and after many punctures, may detract from the appearance of the pad.

In another instance, as disclosed in U.S. Pat. No. 4,432,456 to Ovadia et al, each jewelry pad is formed by an inner layer of plastic, such as styrene, and an outer flocked layer overlying the inner layer to provide a rich look thereto. Earring support mounts in the form of hemispherical or rounded recesses are blow molded into the inner plastic layer for gripping earring posts inserted therein. However, the upper open ends of the hemispherical recesses are covered by the outer flocked layer, and are not normally visible during use. Therefore, the hemispherical recesses must be located by trial and error, and thereby, the outer flocked layer may have many pin holes punched therein by the earring posts. This detracts from the appearance of the pad after many punctures. More importantly, the earring posts are only gripped by a thin layer of plastic at a hole in the bottom of each hemispherical recess through which the earring posts are inserted. The hemispherical recesses could not be used to frictionally hold a jewelry item since the inclined walls thereof would apply a biasing force to force the jewelry item out of the hemispherical recess. In any event, the hemispherical recesses are not open at the upper surface of the jewelry pad, since they are covered by the flocked layer.

This patent also discloses blow molded chain depressions having slots therein at one edge and at the corners for supporting necklace chains. The flexibility of the plastic allows the chain to be gripped. However, the patent again specifically provides the outer flocking layer in covering relation to the slots, specifically to conceal the slots from view, as stated at column 3, lines 51–53. The reason that the slots are concealed is recited as providing a more aesthetically pleasing pad appearance. However, by covering the slots, it makes it more difficult to use the same. Further, the slots can only be provided at the corners or edges of the jewelry pad.

Further, the jewelry pad of this patent is more difficult and costly to construct since the jewelry pad is formed from two separate pieces, namely a molded plastic inner layer and an outer flocked layer overlying the inner layer.

In still another instance, the planar upper surfaces of the pads may be provided with rectangular openings through which a ring can be inserted and held therein. However, in such case, only the planar upper surface is used for gripping the rings, which does not provide a good gripping action. Alternatively, a foam material is placed beneath each opening to better grip the rings. However, this adds to the cost and complexity of the jewelry pad.

OBJECTS AND SUMMARY OF THE INVENTION

Accordingly, it is an object of the present invention to provide a jewelry pad that overcomes the problems with the aforementioned prior art.

It is a principal object of the present invention to provide an injection molded rubbery pad that is flexible and does not lose memory, thereby fitting securely into an undercut in a jewelry tray and never falling out, or becoming deformed like foam rubber pads.

It is still another object of the present invention to provide such a jewelry pad which is formed as a unitary, single piece.

It is a further object of the present invention to provide a jewelry pad having at least one projection on the upper surface thereof for gripping or holding a jewelry item.

In accordance with a still further aspect of the present invention, a jewelry pad for holding jewelry items, includes an upper wall having an upper exposed surface; at least one supporting wall connected to the upper wall for supporting the upper wall on a surface; and at least one projection extending upwardly from and formed integrally with the upper wall for holding a jewelry item thereon. In a further embodiment, the at least one projection includes two fingers, each having one end connected with the upper surface of the upper wall, with opposite free ends of the fingers extending toward each other and spaced apart from each other by a small gap.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
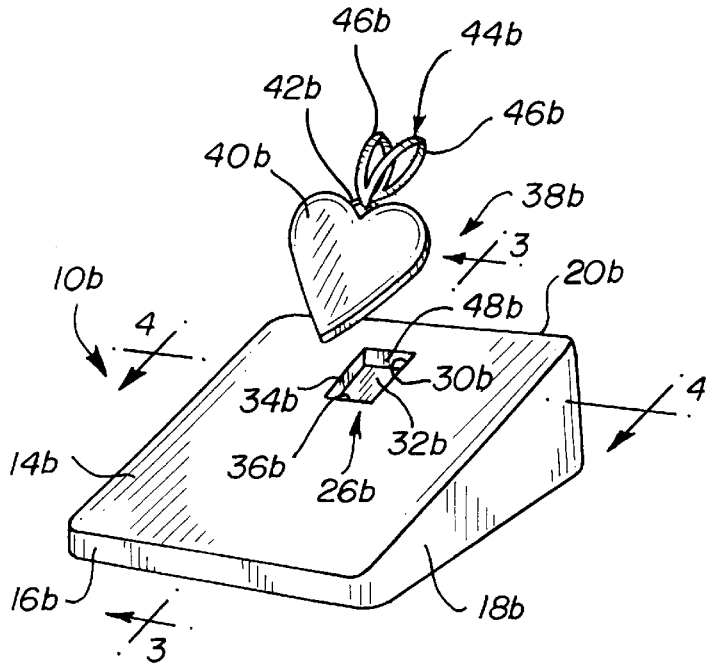
FIG. 1 is a perspective view of a jewelry pad according to an embodiment of the present invention, with a jewelry item to be inserted therein spaced thereabove.

Referring to the drawings in detail, and initially to FIGS. 1–4 thereof, a deformable and resilient jewelry pad 10*b* according to one embodiment of the present invention includes a substantially rectangular upper inclined wall 14*b* that extends upwardly and rearwardly from the upper edge of a front wall 16*b* thereof at an inclination of about 20° to a flat or ground surface. The angular orientation provides that the subsequently discussed recesses do not touch the flat surface when the pad is removed from the tray and placed on the flat surface, while also providing an improved view of the jewelry item. Inclined wall 14*b* can have a slightly convex bowed configuration. Triangular side walls 18*b* each having an upper inclined edge are connected with a respective side edge of inclined wall 14*b,* and a substantially rectangular rear wall 20*b* has its upper edge connected with the rear edge of inclined wall 14*b* and its opposite side edges connected to the rear edges of triangular side walls 18*b*. Rear wall 20*b* may be inclined rearwardly and downwardly at an inclination of, for example, about 15°. In addition, rear wall 20*b* may have a slightly concave bowed configuration. With this arrangement, the lower edges of front wall 16*b,* side walls 18*b* and rear wall 20*b,* lie in the same horizontal plane and support pad 10*b* on a flat surface.

Preferably, each pad lob is made from a flexible plastic material that can be deformed but which retains its shape when the deformation force is removed. Alternatively, each pad 10*b* can be made of a rubber or any other suitable material. In any event, each pad lob is made of a high memory material with a substantially thin, constant thickness throughout. Because pads 10*b* have a substantially constant thickness throughout, they are thin and therefore easily deformable, while reducing the amount of material that is used. Each pad 10*b* fits within a recess of a jewelry tray (not shown), as is well known, and is held therein.

Preferably, each pad lob is formed as a single, unitary plastic molded part, although it is also possible to provide a fabric material or flocked layer thereon.

Specifically, unlike conventional jewelry pads, each pad 10*b* is formed in an injection molding operation, using pellets of an injection molding material, such as polypropylene, olefinic materials, polyurethane, and other synthetic rubber, plastic rubber or flexible materials. An example of such a material is one sold under the trademark KRATON. Thus, the pellets are placed in a conduit leading to a space between two mold halves. The pellets are heated to liquify the same, and the liquid is forced under pressure to a space between the two closed two mold halves to form the jewelry pad. Then, the mold is cooled, and the mold halves are separated, in order to remove the formed jewelry pad therefrom. The formation of jewelry pads by injection molding has not been performed prior to the present invention.

Injection molded rubbery pads 10*b* are flexible and do not lose memory. They fit securely into an undercut in the jewelry tray and never fall out, or become deformed like foam rubber pads.

"Memory" pads 10*b* are made of a soft, flexible material which contain flexible, rubbery mechanisms that hold a jewelry item or items thereon. The flexible pads are further aesthetically appealing. The "rubbery" mechanisms for holding the jewelry items thereon vary in design for each different type of jewelry item, but consistently hold jewelry items without the use of any devices, such as wires or pins and without special trays for each kind of jewelry item and without the requirement to remove the pad from the jewelry tray to insert or remove the jewelry items. These rubbery holding devices are molded right into the pad or molded into plugs which can be inserted into recesses in the pad. Once a plug is inserted it does not have to be removed to remove or replace a jewelry item.

Manufacturers will benefit from the ability to remove a pad and use it as an individual display which can be placed on the counter for the buyer to focus on an individual piece. Opening the bottom of the tray takes full advantage of the three-dimensional landscaping because the hollow pad above it allows room for a higher piece to stack below it. This also decreases the weight without at all taking from the strength of the tray for traveling.

Further, the use of injection molding to form the pads, enables the pads to be made transparent or translucent (hereinafter referred together as "at least translucent"). In this manner, a light can be placed underneath or behind a jewelry pad to better illuminate the jewelry item held thereby.

Examples of specific holding mechanisms will now be described in detail.

As shown, one such pad 10*b* is formed with a generally rectangular parallelepiped recess 26*b* in upper inclined wall 14*b,* and spaced inwardly from peripheral edges of upper inclined wall 14*b*. Recess 26*b* forms one type of holding mechanism. In this regard, there is a rectangular cut-out 30*b* in upper inclined wall 14*b* to form the open upper end of recess 26*b*.

Recess 26*b* is formed by a bottom wall 32*b,* side walls 34*b,* a front wall 36*b* and a rear wall 48*b*. Specifically, parallel spaced apart side walls 34*b* are parallel to side walls 18*b* but spaced inwardly therefrom, with the rear edges of side walls 34*b* being connected to rear wall 48*b* and with the lower edges of side walls 34*b* being connected to side edges of bottom wall 32*b*. Front wall 36*b* extends down from upper inclined wall 14*b* at the front edge of cut-out 30*b,* with side edges of front wall 36*b* being connected to front edges of side walls 34*b* and with the bottom edge of front wall 36*b* being connected to the front edge of bottom wall 32*b*. Finally, rear wall 48*b* extends down from upper inclined wall 14*b* at the rear edge of cut-out 30*b,* with side edges of rear wall 48*b* being connected to rear edges of side walls 34*b* and with the bottom edge of rear wall 48*b* being connected to the rear edge of bottom wall 32*b*.

As one example of a jewelry item 38*b* that can be held therein, there is shown a flat, heart shaped pendant 40*b* having a short semi-circular bail 42*b* fixed to an upper end thereof. A finding 44*b* in the form of rabbit ears 46*b* is connected to bail 42*b* in a well known manner. In this case, rabbit ears 46*b* are slightly biased toward each other and inserted into recess 26*b,* and then released, whereupon rabbit ears 46*b* are biased outwardly by the natural spring action thereof, so that they are frictionally held by side walls 34*b* of recess 26*b,* with the depth of insertion being limited by bottom wall 32*b* and front wall 36*b* of recess 26*b*. Alternatively, it may be sufficient to merely place rabbit ears 46*b* within recess 26*b* without a friction fit thereof.

Since recess 26*b* is exposed at the upper end thereof, there is no need to provide any securing mechanism at the back of pad 10*b* or to puncture pad 10*b* in any manner to hold jewelry item 38*b*. Thus, it becomes relatively easy for a salesperson to remove jewelry item 38*b* from pad 10*b* to show the same, and to then reinsert jewelry item 38*b* back into recess 26*b*.

Figure 5:
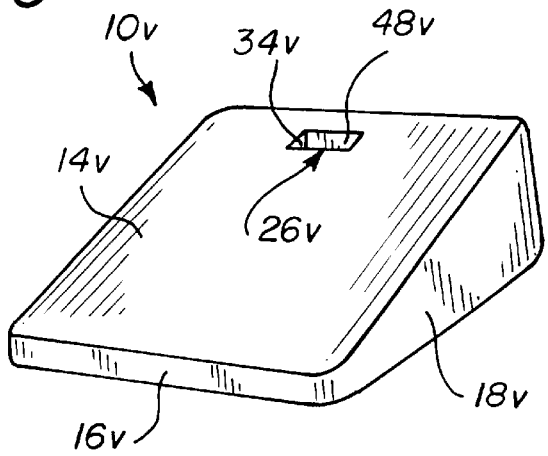
FIG. 5 is a perspective view of a jewelry pad according to another embodiment of the present invention.
Figure 6:
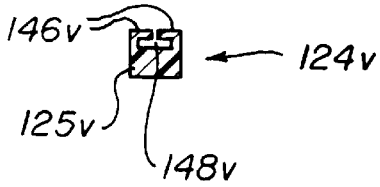
FIG. 6 is a cross-sectional view of a plug according to another embodiment of the present invention for use with the jewelry pad of FIG. 5.

Referring to FIGS. 5 and 6, a jewelry pad 10*c* according to another embodiment of the present invention will now be described in which elements corresponding to those of jewelry pad 10*b* are identified by the same reference numerals, but with the letter "c" added thereto, and a detailed description of the common elements will be omitted for the sake of brevity.

In this embodiment, there are two spaced apart, small diameter cylindrical recesses 26*c* formed by cylindrical walls 34*c* in surrounding relation to cut-out 30*d,* each wall 34*c* closed by a bottom wall 32*c* and each open and exposed at upper inclined wall 14*c*. Bottom wall 32*c* may be eliminated, if desired. In this embodiment, jewelry items 38*c* are small earrings formed by a small disk 50*c* having a semi-spherical gem 52*c* mounted therein, and an earring post 54*c* extending axially from the opposite side of disk 50*c*. Post 54*c* extends through an open and exposed recess 26*c* and is frictionally held within the respective cylindrical wall 34*c* thereof. Alternatively, it may be sufficient to merely place post 54*c* within recess 26*c* without a friction fit thereof.

Referring now to FIGS. 7–10, a jewelry pad 10*d* according to another embodiment of the present invention will now be described in which elements corresponding to those of jewelry pad 10*b* are identified by the same reference numerals, but with the letter "d" added thereto, and a detailed description of the common elements will be omitted for the sake of brevity.

In this embodiment, recesses 26*d* are formed with a cylindrical configuration, having a cylindrical side wall 34*d* extending down from inclined upper wall 14 in surrounding relation to cut-out 30*d* and closed by a bottom wall 32*d*. Bottom wall 32*d* may be eliminated, if desired. In addition, there is a small diameter hole 56*d* or, alternatively, a diametrical slit (not shown) in bottom wall 32*d*.

Jewelry item 38*d* includes a bulbous heart shaped earring 58*d* having a post 60*d* extending from the bottom thereof. A conventional back 62*d* constitutes the finding and extends over post 60*d* to hold earring 58*d* on the ear of a person. Back 62*d* includes two circular pieces of metal 64*d* connected by a flat piece of metal 66*d* having a hole (not shown) therein through which post 60*d* fits, wherein post 60*d* is frictionally held between circular pieces of metal 64*d*.

With this arrangement, back 62*d* is inserted into recess 26*d* in much the same way as rabbit ears 44*b*. As a result, the spring-like nature of back 62*d* forces circular pieces of metal 64*d* apart so that they are frictionally held by side wall 34*d* of recess 26*d,* with the depth of insertion being limited by bottom wall 32*d*. Alternatively, it may be sufficient to merely place back 62*d* within recess 26*d* without a friction fit thereof. Further, back 62*d* can be inserted into recess 26*d* while it is positioned on post 60*d,* in which case, post 60*d* extends through hole 56*d* in bottom wall 32*d*. Thus, the entire securing mechanism of the earring, including the post 60*d* and back 62*d* is held at the top of jewelry pad 10*d,* and there is no need to remove back 62*d* and reattach it to post 60*d* at the underside of jewelry pad 10*d,* as is conventional in the art.

Referring now to FIG. 11, a jewelry pad 10*e* according to another embodiment of the present invention will now be described in which elements corresponding to those of jewelry pad 10*b* are identified by the same reference numerals, but with the letter "e" added thereto, and a detailed description of the common elements will be omitted for the sake of brevity.

As shown, the front wall is eliminated and upper inclined wall 14*e* extends to the level of the flat surface on which jewelry pad 10*e* sits. In this embodiment, rear wall 20*e* is inclined to a much greater extent than in the aforementioned embodiments, for example, at a similar angle as upper inclined wall 14*e*.

Two recesses 26*e* are formed, each in a triangular configuration, that is, with parallel, spaced apart triangular side walls 34*e* having their apices along the edge connecting upper inclined wall 14*e* and rear wall 20*e*. A bottom wall 32*e* connects lower edges of side walls 34*e* and is connected at the front edge thereof to the front lower edge of cut-out 30*e* of upper inclined wall 14*e* and at the rear edge thereof to the rear lower edge of a cut-out 28*e* of rear wall 20*e*.

In this case, jewelry item 38*e* is a cuff link having a button 68*e* with a post 70*e* extending from the bottom thereof and a latch arm 72*e,* which constitutes the finding, pivotally connected at the center thereof to the free end of post 70*e*. Thus, it is only necessary to force fit latch arm 72*e* into recess 26*e,* that is, between side walls 34*e,* where it is frictionally held. Then, post 70*e* pivots down until button 68*e* rests on upper inclined surface 14*e* for display.

Referring now to FIGS. 12–16, a jewelry pad 10*f* according to another embodiment of the present invention will now be described in which elements corresponding to those of jewelry pad 10*b* are identified by the same reference numerals, but with the letter "f" added thereto, and a detailed description of the common elements will be omitted for the sake of brevity.

In this embodiment, side walls 34*f* of generally rectangular parallelepiped recess 26*f* are spaced a large distance apart, that is, side walls 34*f* are spaced apart over a large widthwise portion of jewelry pad 10*f*, with the spacing between side walls 34*f* being generally greater than 50% of the width of jewelry pad 10*f*. However, the length of side walls 34*f* is very small, so that front wall 36*f* and rear wall 48*f* are very long, but are spaced apart by a small distance from each other. Because of the resilient and deformable nature of jewelry pad 10*f*, including side walls 34*f*, when a ring 74*f* is force fit between side walls 34*f*, front wall 36*f* and rear wall 48*f* are forced apart in the parallel relation shown in FIG. 15 to frictionally hold ring 74*f* therein. Further, side walls 34*f* are deformed so as to be forced apart by ring 74*f*, as shown in FIG. 16. In this manner, ring 74*f* is frictionally held on four sides. Thus, there is no need for any additional securing means such as foam pads or the like, as is conventional. Further, unlike cases where a ring is held only in a small opening in upper inclined wall 14*f*, with the present invention, ring 74*f* is held along the entire height of side walls 34*f* and by front wall 36*f* and rear wall 48*f*, that is, on all four sides of recess 26*f*, to provide better securement therein in jewelry tray 10*f*.

It will be appreciated that the height of walls 34*f*, 36*f* and 48*f* can vary. For example, the heights may extend near the supporting surface, that is, near the bottom edge of jewelry pad 10*f*.

It will further be appreciated that the bottom wall of recess 26*f* has been eliminated in this embodiment in order to provide more flexibility of side walls 34*f*, front wall 36*f* and rear wall 48*f* for different size rings. However, a bottom wall may be provided with recess 26*f*, if desired.

Referring now to FIGS. 17–20, a jewelry pad 10*g* according to another embodiment of the present invention will now be described in which elements corresponding to those of jewelry pad 10*b* are identified by the same reference numerals, but with the letter "g" added thereto, and a detailed description of the common elements will be omitted for the sake of brevity.

In this embodiment, there are no recesses. Instead, thin upper inclined wall 14*g* is formed with a central L-shaped hole 76*g* that is cut-out partially from the rear edge of upper inclined wall 14*g* and from the upper edge of rear wall 20*g*. A substantially triangular shaped hole 78*g* is formed in upper inclined wall 14*g* immediately below L-shaped hole 76*g* with a gap therebetween. As a result, upper inclined wall 14*g* is formed with a supporting cross piece 80*g* therebetween. A slit 81*g* divides supporting cross piece 80*g* into two opposing fingers 83*g* and 85*g*.

Jewelry item 38*g* in this case is the same as jewelry item 38*b* of FIG. 1. Thus, opposing fingers 83*g* and 85*g* can be separated due to the deformable nature of the pad material, with rabbit ears 46*g* being inserted so that fingers 83*g* and 85*g*, due to the resilient nature thereof and after the biasing force thereon is removed, extend into rabbit ears 46*g* so as to removably secure rabbit ears 46*g* to jewelry pad 10*g*. Thus, rabbit ears 46*g* are removably held by fingers 83*g* and 85*g*.

Thus, with this embodiment, there is no need to provide any puncture of jewelry pad 10*g* or to provide a securing element for jewelry item 38*g*.

Referring now to FIGS. 21 and 22, a jewelry pad 10*h* according to another embodiment of the present invention, for use with bracelets and the like, will now be described. Jewelry pad 10*h* includes a thin elongated sinusoidal or wave-like rigid housing 82*h* having a generally rectangular cross-sectional configuration. A central elongated sinusoidal or wave-like recess 84*h* is formed in the upper surface of housing 82*h* and extends for most of the length of housing 82*h*. Recess 84*h* has a generally rectangular cross-sectional configuration. A resilient and deformable U-shaped insert 86*h* is removably mounted in recess 84*h*, with outer dimensions of insert 86*h* corresponding generally to the inner dimensions of recess 84*h*. Insert 86*h* is formed with opposite side walls 88*h* and a thin bottom wall 90*h* which supports side walls 88*h* is parallel spaced relation to each other on opposite sides of bottom wall 90*h*. Bottom wall 90*h* has the same dimensions as recess 84*h* and fits perfectly therein. Alternatively, insert 86*h* can be fixed in recess 84*h* by an adhesive or the like.

In this case, a diamond bracelet 92*h* is shown seated on insert 86*h* between side walls 88*h* thereof. Diamond bracelet 92*h* includes an elongated metal band 94*h* or the like with side prongs or gripping elements 96*h*, and a plurality of diamonds 98*h* spaced therealong and gripped by prongs 96*h*.

The inner dimensions of insert 86*h*, that is, the spacing between the inner surfaces of side walls 88*h* is selected to be slightly smaller than the outer dimensions of metal band 94*h* and prongs 96*h*, whereby metal band 94*h* and prongs 96*h* are force fit between side walls 88*h*. Because of the deformable and resilient nature of side walls 88*h*, side walls 88*h* are deformed to grip metal band 94*h* and prongs 96*h*.

As discussed above, insert 86*h* is preferably removable. Therefore, different inserts 86*h* can be used, each with different inner dimensions provided between side walls 88*h*. For example, as shown in FIG. 23, for larger size bracelets 92*i*, a different size insert 86*i* is selected, that is, one having a larger inner dimension to accommodate the larger bracelet 92*i*. Elements of insert 86*i* corresponding to those of insert 86*h* of jewelry pad 10*h* are identified by the same reference numerals, but with the letter "i" added thereto, and a detailed description of the common elements will be omitted for the sake of brevity.

Therefore, unlike conventional pads for holding bracelets, there is no need to provide any securement such as bands that extend all of the way around the pad, securing pins extending from the pad, or the like. Further, because of the wave-like nature of the jewelry pads of FIGS. 21–23, the bracelet is automatically set in the same wave-like manner to provide an excellent display thereof.

It will be appreciated that, while jewelry pad 10*h* has been shown with a wave-like or sinusoidal configuration, it is not so limited. For example, it may be formed in a circular arrangement, with the recess, the insert and the side wall of the insert also being formed in a circular configuration.

Referring now to FIG. 24, a modified insert 86*j* for use with jewelry pad 10*h* according to another embodiment of the present invention will now be described in which elements corresponding to those of insert 86*h* are identified by the same reference numerals, but with the letter "j" added thereto, and a detailed description of the common elements will be omitted for the sake of brevity.

In FIG. 24, insert 86*j* not only extends within recess 84*h*, but also has an extension 100*j* that wraps about the outer surface of the side walls 102*h* of housing 82*h*, to provide better securement of insert 86*j* thereto, while also providing an aesthetically pleasing appearance to the outside of pad 10*h*.

Referring now to FIG. 25, a modified insert 86*k* for use with jewelry pad 10*h* according to another embodiment of the present invention will now be described in which elements corresponding to those of insert 86*h* are identified by the same reference numerals, but with the letter "k" added thereto, and a detailed description of the common elements will be omitted for the sake of brevity.

This embodiment differs from that of FIG. 21 in that continuous insert side walls 88*h* are replaced with a plurality of spaced apart side walls 88*k* of a smaller length, each side wall 88*k* mounted on thin bottom wall 90*k* which has the same dimensions as recess 84*h*. Alternatively, smaller U-shaped inserts can be provided in recess 84*h*.

Referring now to FIGS. 26 and 27, a modified insert 86*l* for use with jewelry pad 10*h* according to another embodiment of the present invention will now be described in which elements corresponding to those of insert 86*h* are identified by the same reference numerals, but with the letter "l" added thereto, and a detailed description of the common elements will be omitted for the sake of brevity.

With insert 86*l*, walls 88*l* are hinged at their lower ends to bottom wall 90*l* thereof such that side walls 88*l* normally extend, in an unbiased state, inwardly at angle of about 50° toward each other. Further, the free upper ends 104*l* of hinged side walls 88*l* can be slightly enlarged for better gripping, as will be appreciated from the discussion which follows. In addition, a resting pad 106*l* can be placed within insert 86*l* so as to rest on bottom wall 90*l* thereof, without affecting the hinged nature of side walls 88*l*.

In this manner, when a bracelet 92*l* is inserted within insert 86*l*, that is, between side walls 88*l*, side walls 88*l* are forced apart in a hinged manner, and apply a pressure on bracelet 92*l* to hold the same within insert 86*l*.

As shown in FIG. 28, with this arrangement, different size bracelets $92l_1$ can be inserted and held within insert 86*l*, without changing the insert, as with the fixed inner dimension embodiments of FIGS. 21–25.

It will be appreciated that, with all of the aforementioned jewelry pads, various types of recesses have been provided. However, a larger jewelry pad can be provided with a number of different types of recesses.

Thus, referring now to FIG. 29, a jewelry pad 10*m* according to another embodiment of the present invention will now be described in which elements corresponding to those of jewelry pad 10*b* are identified by the same reference numerals, but with the letter "m" added thereto, and a detailed description of the common elements will be omitted for the sake of brevity.

As shown, jewelry pad 10*m* includes a plurality of pairs of recesses 26*c* (see FIG. 5) and a plurality of recesses 26*b* (see FIG. 1). Although recesses 26*b* and 26*c* are shown, any other combination of recesses and/or other jewelry holding means according to the present invention can be combined into a single jewelry pad.

Referring now to FIGS. 30–33, a jewelry pad 10*q* according to another embodiment of the present invention will now be described in which elements corresponding to those of jewelry pad 10*d* are identified by the same reference numerals, but with the letter "q" added thereto, and a detailed description of the common elements will be omitted for the sake of brevity.

Jewelry pad 10*q* is identical to jewelry pad 10*d*, but with slits 122*q* being provided in the bottom wall 32*q* of each recess 26*q*. Further, jewelry pad 10*q* includes two plugs 124*q*, each including a plastic cylinder base 125*q* having an outer diameter similar to the inner diameter of cylindrical side wall 34*q* of each recess 26*q* so as to fit snugly therein, while also being easily removable therefrom. Further, the height of each base 125*q* is substantially the same as the height of each recess 26*q* such that the upper surface 130*q* of each base 125*q* is substantially flush with the upper surface of upper inclined wall 14*q*.

Each cylinder base 125*q* has a central tapered axial hole 126*q*, as best shown in FIG. 33, which snugly holds an earring post 60*q*, with the lower end of earring post 60*q* extending through slit 122*q*.

Referring now to FIGS. 34 and 35, a jewelry pad 10*r* according to another embodiment of the present invention will now be described in which elements corresponding to those of jewelry pad 10*q* are identified by the same reference numerals, but with the letter "r" added thereto, and a detailed description of the common elements will be omitted for the sake of brevity.

Jewelry pad 10*r* is identical to jewelry pad 10*q*, but with plugs 124*r*, instead of having a tapered axial hole, each having an inverted U-shaped or half ring-shaped grip 128*r* with opposite ends thereof integrally formed on the upper surface 130*r* of each cylinder base 125*r*. Thus, a bridged opening 132*r* is provided between upper surface 130*r* and half ring-shaped grip 128*r* in order to retain the thin wire clasp 120*r* of a hoop earring 118*r*.

The embodiment of FIG. 36 differs only in that half ring-shaped grip 128*s* of plug 124*s* is cut away at one end so as to extend for less than 180°. Thus, only one end of grip 128*s* is integrally formed with the upper surface 130*s* of cylinder base 125*s*, while the other end thereof is spaced above upper surface 130*s*. Thus, half ring-shaped grip 128*s* in this case functions as a hook for holding a jewelry item thereon.

Referring now to FIGS. 37–40, a jewelry pad 10*t* according to another embodiment of the present invention will now be described in which elements corresponding to those of jewelry pad 10*r* are identified by the same reference numerals, but with the letter "t" added thereto, and a detailed description of the common elements will be omitted for the sake of brevity.

Jewelry pad 10*t* is identical to jewelry pad 10*r*, but with plugs 124*t*, instead of having half ring-shaped grips 128*r*, each having an L-shaped projection 134*t* extending from the upper surface 130*t* of each cylinder base 125*t*. Specifically, each L-shaped projection 134*t* includes a flat rectangular piece 136*t* extending in parallel, spaced relation above upper surface 130*t*, with a small gap 138*t* therebetween, and a connecting member 140*t* that secures flat rectangular piece 136*t* to the center of upper surface 130*t* in such arrangement.

In this case, jewelry item 38*t* is a clip-back earring, that is, having a bulbous heart shaped earring 58*t* with a substantially L-shaped clip 142*t* as the finding, extending from a lower surface thereof, so as to define a gap 144*t* between L-shaped clip 142*t* and the lower surface of earring 58*t*. Gap 144*t* has dimensions slightly smaller than the thickness of flat rectangular piece 136*t* of L-shaped projection 134*t*, such that flat rectangular piece 136*t* fits within gap 144*t* with a friction fit to hold jewelry item 38*t* thereto.

Referring now to FIG. 40, a plug 124*u* according to another embodiment of the present invention will now be described in which elements corresponding to those of plug 124*t* are identified by the same reference numerals, but with the letter "u" added thereto, and a detailed description of the common elements will be omitted for the sake of brevity.

The plug 124*u* of FIG. 40 differs slightly from the plug 124*t* in that connecting member 140*u* is formed as a U-shaped member and attaches to the outer cylindrical surface of cylinder base 125*u* at an upper end thereof, with one leg being coplanar and integrally formed with flat rectangular piece 136*u*.

Referring now to FIGS. 41–45, a jewelry pad 10*v* according to another embodiment of the present invention will now be described in which elements corresponding to those of jewelry pad 10*r* are identified by the same reference numerals, but with the letter "v" added thereto, and a detailed description of the common elements will be omitted for the sake of brevity.

Jewelry pad 10*v* is identical to jewelry pad 10*r*, except that recess 26*v* is formed in a generally rectangular parallelepiped configuration, similar to recess 26*b* of FIG. 1 but with different dimensions. As a result, plugs 124*v* include a generally rectangular parallelepiped base 125*v* in place of the cylinder bases of the aforementioned plugs, and of the same general dimensions as recesses 26*v* so as to snugly fit therein.

Further, in place of half ring-shaped grips 128*r* of plugs 124*r*, each plug 124*v* has two L-shaped fingers 146*v* having one end integrally formed with the upper surface 130*v* of plug 124*v* and the other ends facing each other with a small gap 148*v* therebetween. Thus, the upper facing portions of L-shaped fingers 146*v* form a substantially continuous holder for jewelry item 38*v* which is identical to jewelry item 38*b* of FIG. 1. In this case, rabbit ears 46*v* are held by L-shaped fingers 146*v*. In the context of the present invention, reference to an L-shape in relation to fingers 146*v* is intended to encompass various modifications thereof, such as fingers having the general shape of a quarter circle, a quarter oval, various bent configurations and the like.

Specifically, opposing fingers 146*v* can be separated due to the deformable nature thereof, with rabbit ears 46*v* being inserted so that fingers 146*v*, due to the resilient nature thereof and after the biasing force thereon is removed, extend into rabbit ears 46*v* so as to removably secure rabbit ears 46*v* to jewelry pad 10*v*. Thus, rabbit ears 46*v* are removably held by fingers 146*v*.

Thus, with this embodiment, there is no need to provide any puncture of jewelry pad 10*v* or to provide a securing element for jewelry item 38*v*.

Of course, it will be appreciated that the various fingers need not be identical.

For example, as shown in FIG. 42A, plug 224*v* includes two L-shaped fingers 246*v* and 247*v* on a base 225*v*, with a small gap 248*v* between the free ends of fingers 246*v* and 247*v*, and with finger 246*v* being longer than finger 247*v*.

In like manner, as shown in FIG. 42B, a plug 324*v* includes a vertical finger or post 347*v* on a base 325*v* and which is substituted for finger 247*v*, in which case finger 346*v* extends even longer to a position above post 347*v*, and is separated by a small gap 348*v* therefrom.

FIG. 42C shows a plug 424*v* which is a variation of plug 324*v*, but in which post 447*v* extends to the same height from base 425*v* as finger 446*v*, with a gap 448*v* therebetween.

FIG. 42D shows a plug 524*v* which is a variation of plug 324*v*, but in which there is only L-shaped one finger 546*v* extending from base 525*v* and having a downturned end 549*v* which is separated from the upper surface of base 525*v* by a small gap 528*v*.

FIG. 42E shows a plug 824*v* which is a variation of plug 124*v*, but in which the L-shaped fingers 846*v* extending from base 825*v* have free ends with a complementary curvature that contact and mate with each other in an overlapping manner, but which can be separated from each other. Thus, in the unbiased position, there is no gap between the free ends of L-shaped fingers 846*v*.

FIG. 42F shows a plug 924*v* which is a variation of plug 824*v*, with the only difference being that the free ends of L-shaped fingers 946*v* are cut on a diagonal. The free ends of L-shaped fingers 946*v* contact and mate with each other, and can be separated from each other. Thus, in the unbiased position, there is no gap between the free ends of L-shaped fingers 946*v*.

FIG. 42G shows a plug 1024*v* which is a variation of plug 524*v*, but in which there is a single U-shaped finger 1046*v* having one end integrally formed with base 1025*v* and the opposite free end removably engaged within a hole 1027*v* in base 1025*v*. Because of the deformable and resilient nature of the material used to construct the same, the free end can be removed from hole 1027*v* to receive a jewelry item and then released whereby it will automatically re-enter hole 1027*v* to removably secure the jewelry item to base 1025*v*.

Referring now to FIGS. 46–48, a plug 124*w* according to another embodiment of the present invention will now be described in which elements corresponding to those of plug 124*r* are identified by the same reference numerals, but with the letter "w" added thereto, and a detailed description of the common elements will be omitted for the sake of brevity.

With plug 124*w*, in addition to a cylinder base 125*w*, there is a ring holder 150*w* made of a deformable and resilient plastic material secured to upper surface 130*w* of base 125*w*. As shown, ring holder 150*w* has a general shape of the number "8" with a concave mid-portion such that a ring is inserted thereover and is retained on the narrow concave mid-portion of ring holder 150*w*. Ring holder 150*w* can have a slightly bulbous configuration as shown in FIG. 47, or can have a generally planar configuration as shown in FIG. 48. Of course, it will be appreciated that the recess in the jewelry pad would be situated at a lower portion of the upper inclined wall thereof to properly display a ring on ring holder 150*w*.

Of course, any other suitable holding means can be provided on the plugs.

Further, any of the holding means on the plugs of FIGS. 30–48 can be permanently affixed to or provided on the upper inclined surface of a jewelry pad, rather than be provided on a plug arrangement.

In addition, it will be appreciated that, where applicable, the base of the plug may be hollow to mount on a post or the like extending from the jewelry pad. As an example, base 125*w* of plug 124*w* may be hollow to receive a post on the upper surface of the jewelry pad.

Referring now to FIG. 49, a jewelry pad 10*x* according to another embodiment of the present invention will now be described in which elements corresponding to those of jewelry pad 10*b* are identified by the same reference numerals, but with the letter "x" added thereto, and a detailed description of the common elements will be omitted for the sake of brevity.

Specifically, with jewelry pad 10*x*, instead of a recess being provided in upper inclined wall 14*x*, two jewelry grasping projections 108*x* are formed on upper inclined wall 14*x*. Each jewelry grasping projection 108*x* includes two solid semi-cylindrical projections 110*x*, each having a semi-cylindrical outer side wall 112*x* and a generally rectangular flat inner side wall 114*x* of the same height as side wall 112*x* and connected to opposite ends thereof. The generally rectangular inner side walls 114*x* of the two jewelry grasping projections 108*x* are in parallel, facing relation to each other with a small gap 116*x* therebetween. In this embodiment, gap 116*x* extends generally parallel to front wall 16*x*. It will be appreciated that projections 110*x* are not limited to the aforementioned semi-cylindrical shape or the orientation thereof.

This embodiment is particularly adapted to holding hoop earrings 118*x* as the jewelry item 38*x*. Such hoop earrings 118*x* have a general ring shape with a small gap which is closed by a removable thin wire clasp 120*x* which functions as the finding.

In operation, it is only necessary to slip thin wire clasp 120*x* into gap 116*x* in order to removably hold hoop earrings 118*x* on upper inclined wall 14*x*.

Referring now to FIG. 50, a jewelry pad 10*y* according to another embodiment of the present invention will now be described in which elements corresponding to those of jewelry pad 10*x* are identified by the same reference numerals, but with the letter "y" added thereto, and a detailed description of the common elements will be omitted for the sake of brevity.

Jewelry pad 10*y* is identical to jewelry pad 10*x*, except that solid semi-cylindrical projections 110*y* are turned by 90° from those in jewelry pad 10*x*, and gap 116*y* is much larger. As shown, the front wall is eliminated and upper inclined wall 14*y* extends to the level of the flat surface on which jewelry pad 10*y* sits. In this embodiment, rear wall 20*y* is inclined to a greater extent than in the aforementioned embodiments.

In this case, jewelry pad 10*y* is intended to hold a cuff link 38*y* which is identical to cuff link 38*e* of FIG. 11. Thus, it is only necessary to force fit latch arm 72*y* into gap 116*y*, that is, between spaced rectangular outer wall surfaces 114*y*, where it is frictionally held. Then, post 70*y* pivots down until button 68*y* rests on upper inclined surface 14*y* for display.

It will be appreciated that, while each jewelry pad, recess, projection and plug has been shown with a particular configuration and dimensions, they are not so limited, and have only been shown with the particular configurations and dimensions to explain possible embodiments of the present invention. Further, although particular jewelry items have been shown with particular jewelry pads, other jewelry items may be used with the particular jewelry pads.

Further, it will be appreciated that various different jewelry pads can be combined into a single pad. For example, a single jewelry pad can include a combination of the various arrangements. As a specific example, a single jewelry pad can include the arrangement of cross piece 80*g* of FIG. 23, recesses 26*c* of FIG. 11, projections 108 of FIG. 36 and recesses 26*q* and plugs 124 of FIG. 39.

Referring now to FIG. 51, a large jewelry pad 10*z* can be provided with a plurality of pairs of L-shaped fingers 146*z*, each finger 146*z* having one end integrally formed at the upper edge of upper surface 14*z* of pad 10*z*, and the other ends facing each other with a small gap 148*z* therebetween. Thus, the upper facing portions of L-shaped fingers 146*v* form a substantially continuous holder for jewelry items such as chains 38*z*, which hang down therefrom onto upper surface 14*z* for display. Only one such chain 38*z* is shown.

Specifically, opposing fingers 146*z* can be separated due to the deformable nature thereof, with chains inserted therebetween. Fingers 146*z*, due to the resilient nature thereof and after the biasing force thereon is removed, return to their original state to removably secure chains 38*z* to jewelry pad 10*z*. Thus, chains 38*z* are removably held by fingers 146*z* in vertically parallel relation to each other.

Alternatively, or in addition thereto, jewelry pad 10*z* can be provided with a plurality of recesses 26*v* (see FIG. 41) in a number of columns. The recesses 26*v* in only one column are shown for ease of explanation. Then, a plug 124*v* (see FIG. 42) can be inserted into a selected recess 26*v* in a column, depending upon the length of the chain 38*z*.

As another modification, as shown in FIG. 52, a jewelry pad 610*a* can have a plurality of recesses 26*v* which are identical to those of FIGS. 41–45 formed on upper inclined surface 614*a* thereof around a circular area 613*a*, and plugs 124*v* which are identical to those of FIGS. 41–45 can be inserted therein for holding a necklace (not shown) therearound.

As shown in FIG. 53, instead of the ring holder of FIG. 46 being formed as part of a plug, it may formed integrally with a jewelry pad 610*b*. Specifically, a ring holder 650*b*, which is identical to ring holder 150*w* of FIG. 46, may be cut out from the upper inclined surface 614*b* of jewelry pad 610*b*, except for a bottom portion thereof at which ring holder 650*b* is hinged to upper inclined surface 614*b*. Ring holder 650*b* is made of a deformable and resilient plastic material. As shown, ring holder 650*b* has a general shape of the number "8" such that a ring is inserted thereover and is retained on the narrow concave mid-portion of ring holder 650*b*. However, any shape similar to a finger that has a concave or reduced width area to locate the ring thereon, and which is proportional to the size of most rings, can be used. Ring holder 650*b* can have a slightly bulbous configuration as shown in FIG. 54, or can have a generally planar configuration as shown in FIG. 55.

Still further, as described above, various combinations can be provided on a jewelry pad 610*c*, as shown, for example, in FIG. 56. As shown therein, two recesses 26*q* (see FIG. 30), a recess 26*v* and a plug 124*v* (see FIG. 43) and ring holder 650*b* (see FIG. 53) can be combined in the upper inclined surface 614*c* of a jewelry pad 610*c*, which is also provided with a front wall 616*c*, side walls 618*c* and a rear wall (not shown). Jewelry pad 610*c* is shown encased in a packing box 700 at the point of sale, with packing box 700 having a square flat base 702 on which jewelry pad 610 sits, and a cover 704 which fits thereover.

Referring now to FIGS. 57 and 58, a jewelry pad 10*a* according to another embodiment of the present invention will now be described in which elements corresponding to those of jewelry pad 10*b* are identified by the same reference numerals, but with the letter "a" added thereto, and a detailed description of the common elements will be omitted for the sake of brevity.

As shown therein, jewelry pad 10*a* has an overall configuration similar to jewelry pad 10*b*. However, instead of a recess therein, the jewelry pad 10*a* has two U-shaped outlines 26*a* cut out from upper inclined wall 14*a* thereof, with U-shaped outlines 26*a* being spaced apart from each other. Further, an elongated slot 27*a* associated with each outline 26*a* is cut out from upper inclined wall 14*a* so as to be positioned adjacent the free ends of the U-shaped outline 26*a* and so as to be positioned centrally thereof in a manner to bisect the U-shaped outline 26*a*.

A jewelry item 38*a* has a main body 40*a* with a post 42*a* extending down from the back at one end thereof and a pivotable clasp 44*a* extending down from the back at the other end thereof. The pivotable clasp 44*a* is angled to extend through a respective U-shaped outline 26*a* so that the free end thereof receives the post 42*a* extending through the respective elongated slot 27*a*. In this manner, jewelry item 38*a* is removably held to jewelry pad 10*a*.

Of course, modifications in the particular shape and size of the U-shaped outlines 26*a* and elongated slots 27*a* can be made within the scope of the invention. For example, instead of a U-shaped outline 26, another elongated slot which is transverse to elongated slot 27*a* can be provided, that is, effectively removing the legs of U-shaped outline 26*a*.

Referring now to FIGS. 59–61, a jewelry pad 10*aa* according to another embodiment of the present invention will now be described in which elements corresponding to those of jewelry pad 10*v* are identified by the same reference numerals, but with the letters "aa" added thereto, and a detailed description of the common elements will be omitted for the sake of brevity. Jewelry pad 10*aa* effectively constitutes a modification of jewelry pad 10*v* of FIGS. 41–45, but with recess 26*aa* being constructed such that the distance between front wall 36*aa* and rear wall 48*aa* is much smaller than that of jewelry pad 10*v*. The distance between side walls 34*aa* of recess 26*aa* may be similar to that between side walls 34*v* of jewelry pad 10*v*.

In place of the rectangular parallelepiped base 125*v* used with jewelry pad 10*v*, a flat plate-like, trapezoidal base 125*aa* is used in place thereof, with the lower edge 127*aa* thereof having a greater width than the upper edge 129*aa* thereof. Further, lower edge 127*aa* has a width which is greater than the width of recess 26*aa*, that is, between side walls 34*aa*.

A part-circular ring holder 145*aa* is provided and is centrally connected to upper edge 129*aa* so as to effectively form two arcuate fingers 146*aa* having first ends thereof integrally connected with upper edge 129*aa* and opposite second ends thereof facing each other with a small gap 148*aa* therebetween. Opposing fingers 146*aa* can be deformed toward each other due to the deformable nature thereof, with a ring 74*aa* being inserted thereover. Due to the resilient nature of fingers 146*aa* and after the biasing force thereon is removed, fingers 146*aa* move back to their original positions to hold ring 74*aa* thereon.

Thus, after a ring is placed on ring holder 145*aa* and held thereby, trapezoidal base 125*aa* is inserted into recess 26*aa*. Because bottom edge 127*aa* has a width which is greater than the width of recess 26*aa*, the material of jewelry pad 10*aa* around recess 26*aa* is deformed to permit passage of bottom edge 127*aa* therein. After bottom edge 127*aa* passes the bottom edge of side walls 34*aa* of recess 26*aa*, the walls 34*aa* spring back due to the resilient nature of the material, and thereby hold trapezoidal base 125*aa* therein, such that ring holder 145*aa* and ring 74*aa* thereon are positioned at an angle for display, as shown in FIG. 61. Further, front wall 36*aa* and rear wall 48*aa* may be forced apart in a parallel relation to further frictionally hold trapezoidal base 125*aa* therein.

In addition, an elongated opening 131*aa* is provided immediately behind recess 26*aa*, in order for a price tag 133*aa* which is secured to ring 74*aa* by string 135*aa* or the like to be inserted therethrough and thereby keep price tag 133*aa* out of view so as not to detract from the appearance of ring 74*aa*.

It will be appreciated that the use of a trapezoidal base similar to base 125*aa* can be used in place of any of the other circular or parallelepiped bases 125 previously discussed. Alternatively, such trapezoidal bases 125*aa* can be used to connect an elongated plate 137*bb*, such that the elongated plate 137*bb* and trapezoidal bases 125*aa* together form a U-shaped hold down members, shown in FIG. 62, to secure a bracelet 38*bb* or the like on a jewelry pad 10*bb* having recesses 26*bb* (FIG. 51) similar to recesses 26*aa*.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A jewelry pad comprising:

an upper wall having an upper exposed surface;

at least one supporting wall connected to the upper wall for supporting the upper wall on a horizontal surface such that the upper wall is at most only slightly inclined relative to the horizontal surface;

at least one pair of opposing first and second fingers extending upwardly from and formed integrally as a unitary member with said upper wall for holding a jewelry item thereon, each finger including a first portion extending upwardly from and integrally formed with the upper exposed surface and a second portion which is connected to the first portion so as to extend substantially transversely therefrom in spaced relation from the upper exposed surface, with the second portions being substantially co-linear and extending toward each other and such that said second portions are arranged to retain a jewelry item with the jewelry item resting on the upper exposed surface of the upper wall; and each said finger is totally deformable and resilient so that it can be bent to permit access to the jewelry item retained thereby.

2. A jewelry pad according to claim 1, wherein said second portions of each said pair of opposing fingers have free ends which are at least substantially in contact with each other, and said free ends of both of said first and second fingers are movable away from each other to removably retain at least one said jewelry item thereon.

3. A jewelry pad according to claim 2, wherein said free end of said first finger has a first curved shape, and said free end of said second finger has a second curved shape which is complementary to said first curved shape and which interlocks therewith.

4. A jewelry pad according to claim 2, wherein said free end of said first finger has a first Z-lock surface, and said free end of said second finger has a second Z-lock surface which is complementary to said first Z-lock surface and which interlocks therewith.

5. A jewelry pad according to claim 2, wherein said free end of said first finger has a first angled surface, and said free end of said second finger has a second angled surface which is complementary to said first angled surface and which interlocks therewith.

6. A jewelry pad according to claim 1, wherein said second portions of each said pair of opposing fingers have free ends which are spaced from each other by a gap.

7. A jewelry pad according to claim 6, wherein said free end of said first finger has a first curved shape, and said free end of said second finger has a second curved shape which is complementary to said first curved shape.

8. A jewelry pad according to claim 6, wherein said free end of said first finger has a first Z-lock surface, and said free end of said second finger has a second Z-lock surface which is complementary to said first Z-lock surface.

9. A jewelry pad according to claim 6, wherein said free end of said first finger has a first angled surface, and said free end of said second finger has a second angled surface which is complementary to said first angled surface.

* * * * *

UNITED STATES PATENT AND TRADEMARK OFFICE

CERTIFICATE OF CORRECTION

PATENT NO. : 5,913,417
DATED : June 22, 1999
INVENTOR(S) : Ovakia et al.

It is certified that error appears in the above-identified patent and that said Letters Patent is hereby corrected as shown below:

Please delete columns 1-16 and substitute columns 1-8 as per attached.

Signed and Sealed this

Twenty-eighth Day of August, 2001

Nicholas P. Godici

*Attest:*

*Attesting Officer*

NICHOLAS P. GODICI
*Acting Director of the United States Patent and Trademark Office*

JEWELRY PADS HAVING RECESSES, PROJECTIONS AND/OR PLUGS FOR HOLDING JEWELRY ITEMS

This application is a division of application Ser. No. 08/465,142 filed Jun. 5, 1995, now abandoned.

BACKGROUND OF THE INVENTION

The present invention relates generally to display and storage devices, and more particularly, is directed to jewelry pads for storing and displaying items of jewelry.

In the past, jewelry has been displayed on pads in trays. The pads have been made from plastic, cardboard or foam rubber, and are usually covered with some kind of fabric or flocking to give a plush look for the aesthetic demands of jewelry display, with a layer of foam under the flocking or fabric.

However, these various pads have basic drawbacks. Specifically, plastic and cardboard pads tend to fall out of the trays, while foam rubber pads eventually lost memory from long term pressure. All of these pads became marred, dirty, ugly and eventually have to be replaced.

In the past, jewelry was attached to these pads in the following ways. Post earrings required that a hole be produced in the pad (either in production or by the end user). The earring back would then have to be removed from the earring. The pad would have to be removed from the tray and the earring inserted through the hole in the pad, and thereafter, the back of the earring replaced on the earring behind the pad. Then, the pad with the jewelry could be returned to the tray.

Clip and omega back earrings required a special flap for earrings to be clipped onto it. This required a special tray and post earrings could not be displayed on the same tray as clip earrings. Alternatively, cut-outs in a cardboard or plastic pad would allow the earrings to clip onto the pad in the same tray as the clip earrings, but this added to the cost of labor and detracted greatly from the aesthetic appeal of the presentation.

Pendants and charms have been attached to the above described pads using a separate device, namely, a wire twist pin or unshaped pin. This, however, posed many problems. First, the jewelry was difficult to center on the pad, that is, knowing where to stick the pin. Secondly, removing and replacing the pins to show the jewelry to customers soon ruined the surface of the pad. Third, it is very time consuming to place the jewelry on a pin, and then place the pin on the pad to display the jewelry, while performing the reverse order for removing the jewelry for a customer. This may be performed a dozen times in one day for just one item of jewelry on one pad in a busy store. The disadvantages here are tremendous (not to mention the bloody finger tips and ruined manicures these pins cause daily).

With the above in mind, a conventional jewelry tray includes a plurality of, for example, twelve, shallow closed-bottom recesses, with a cushioned pad held in each recess, each cushioned pad being adapted to hold a jewelry item. For example, in one instance, the posts of earrings or the like can be inserted through the pads with the posts being held at the bottom of the pads by earring backs.

However, this is disadvantageous for a number of reasons. First, in order to remove the earring, it is necessary to remove the pad from the tray, and then remove the earring back. This becomes time-consuming at the point of sale, particularly when a customer is trying on numerous pairs of earrings. Second, the posts of the earrings generally must puncture the pads in order to be inserted therethrough. This sometimes is difficult, and after many punctures, may detract from the appearance of the pad.

In another instance, as disclosed in U.S. Pat. No. 4,432,456 to Ovadia et al, each jewelry pad is formed by an inner layer of plastic, such as styrene, and an outer flocked layer overlying the inner layer to provide a rich look thereto. Earring support mounts in the form of hemispherical or rounded recesses are blow molded into the inner plastic layer for gripping earring posts inserted therein. However, the upper open ends of the hemispherical recesses are covered by the outer flocked layer, and are not normally visible during use. Therefore, the hemispherical recesses must be located by trial and error, and thereby, the outer flocked layer may have many pin holes punched therein by the earring posts. This detracts from the appearance of the pad after many punctures. More importantly, the earring posts are only gripped by a thin layer of plastic at a hole in the bottom of each hemispherical recess through which the earring posts are inserted. The hemispherical recesses could not be used to frictionally hold a jewelry item since the inclined walls thereof would apply a biasing force to force the jewelry item out of the hemispherical recess. In any event, the hemispherical recesses are not open at the upper surface of the jewelry pad, since they are covered by the flocked layer.

This patent also discloses blow molded chain depressions having slots therein at one edge and at the corners for supporting necklace chains. The flexibility of the plastic allows the chain to be gripped. However, the patent again specifically provides the outer flocking layer in covering relation to the slots, specifically to conceal the slots from view, as stated at column 3, lines 51–53. The reason that the slots are concealed is recited as providing a more aesthetically pleasing pad appearance. However, by covering the slots, it makes it more difficult to use the same. Further, the slots can only be provided at the corners or edges of the jewelry pad.

Further, the jewelry pad of this patent is more difficult and costly to construct since the jewelry pad is formed from two separate pieces, namely a molded plastic inner layer and an outer flocked layer overlying the inner layer.

In still another instance, the planar upper surfaces of the pads may be provided with rectangular openings through which a ring can be inserted and held therein. However, in such case, only the planar upper surface is used for gripping the rings, which does not provide a good gripping action. Alternatively, a foam material is placed beneath each opening to better grip the rings. However, this adds to the cost and complexity of the jewelry pad.

OBJECTS AND SUMMARY OF THE INVENTION

Accordingly, it is an object of the present invention to provide a jewelry pad that overcomes the problems with the aforementioned prior art.

It is a principal object of the present invention to provide an injection molded rubbery pad that is flexible and does not lose memory, thereby fitting securely into an undercut in a jewelry tray and never falling out, or becoming deformed like foam rubber pads.

It is still another object of the present invention to provide such a jewelry pad which is formed as a unitary, single piece.

It is a further object of the present invention to provide a jewelry pad having at least one projection on the upper surface thereof for gripping or holding a jewelry item.

In accordance with a still further aspect of the present invention, a jewelry pad for holding jewelry items, includes an upper wall having an upper exposed surface; at least one supporting wall connected to the upper wall for supporting the upper wall on a surface; and at least one projection extending upwardly from and formed integrally with the upper wall for holding a jewelry item thereon.

In a further embodiment, the at least one projection includes two fingers, each having one end connected with the upper surface of the upper wall, with opposite free ends of the fingers extending toward each other and spaced apart from each other by a small gap.

The above and other objects, features and advantages of the invention will become readily apparent from the following detailed description thereof which is to be read in connection with the accompanying drawings.

BRIEF DESCRIPTION OF THE DRAWINGS

Figure 2:
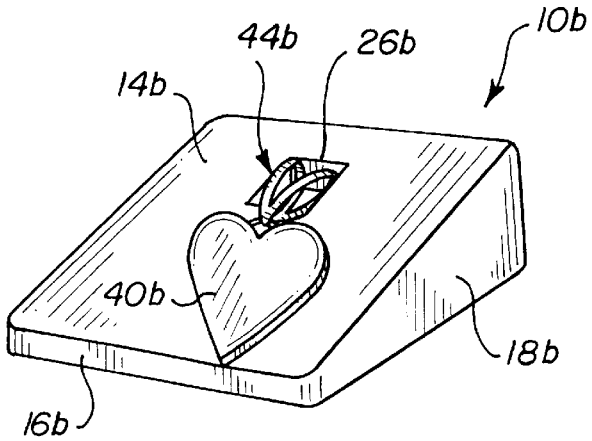
FIG. 2 is a perspective view of the jewelry pad of FIG. 1, with a jewelry item seated thereon.
Figure 3:
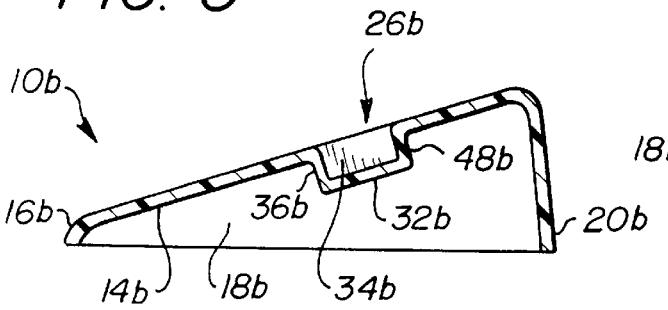
FIG. 3 is a cross-sectional view of the jewelry pad of FIG. 1, taken along line 3—3 thereof.
Figure 4:
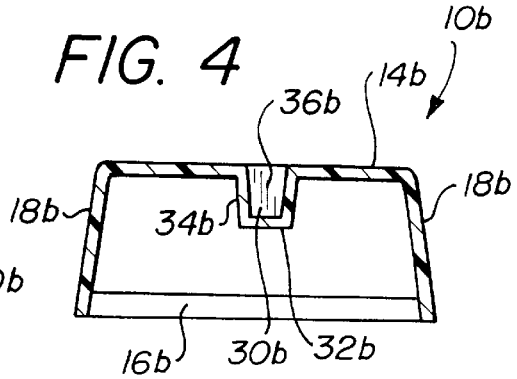
FIG. 4 is a cross-sectional view of the jewelry pad of FIG. 1, taken along line 4—4 thereof.
Figure 6A:
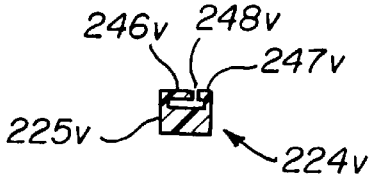
FIG. 6A is a cross-sectional view of a plug similar to that of FIG. 6, but modified therefrom.
Figure 6B:
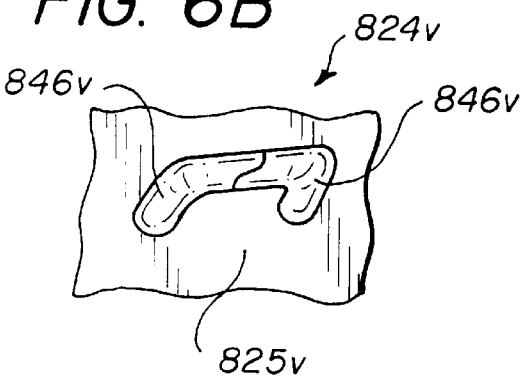
FIG. 6B is a perspective view of a portion of a plug similar to FIG. 6, but modified therefrom.
Figure 6C:
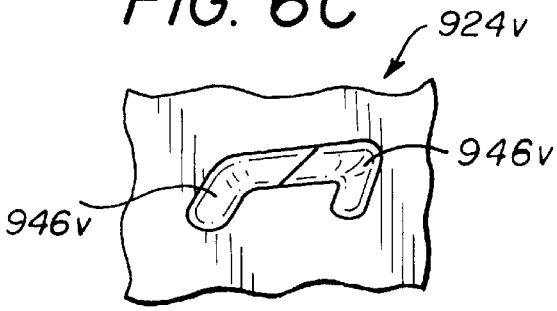
FIG. 6C is a perspective view of a portion of a plug similar to FIG. 6, but modified therefrom.
Figure 7:
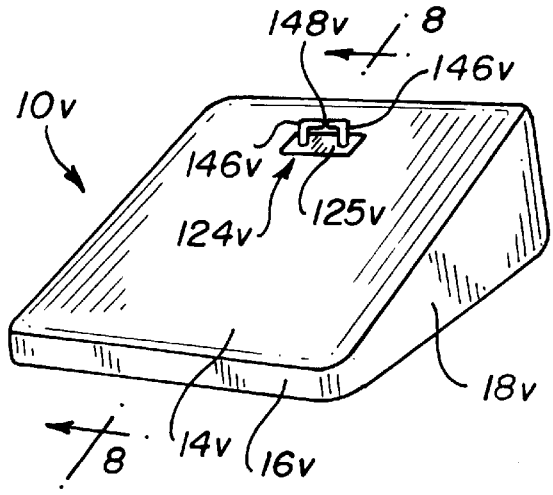
FIG. 7 is a perspective view of the jewelry pad of FIG. 5, with the plug of FIG. 6 inserted therein.
Figure 8:
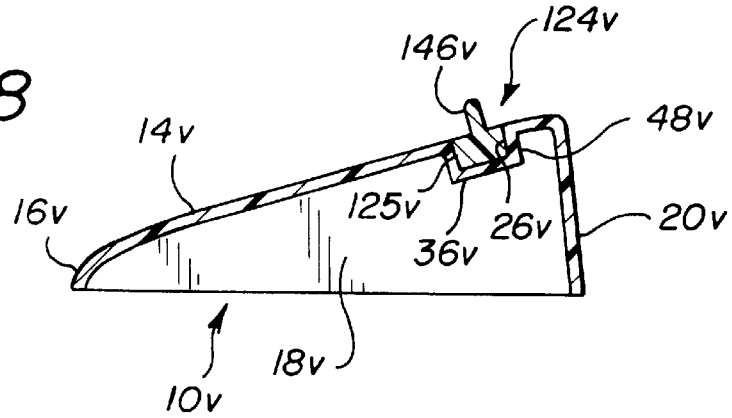
FIG. 8 is a cross-sectional view of the jewelry pad of FIG. 7, taken along line 8—8 thereof.
Figure 9:
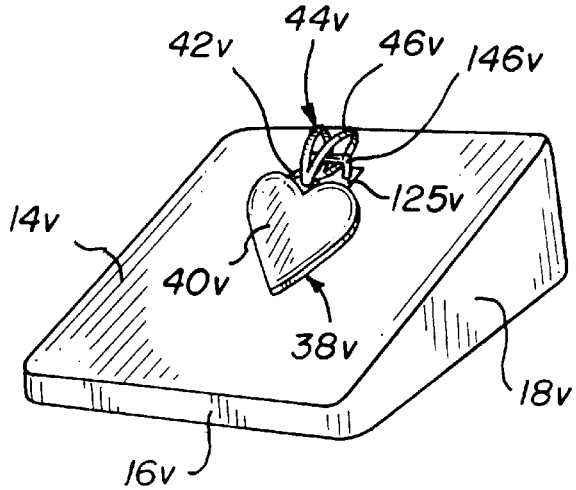
FIG. 9 is a perspective view of the jewelry pad of FIG. 7, with a jewelry item seated thereon.

FIG. 1 is a perspective view of a jewelry pad according to an embodiment of the present invention, with a jewelry item to be inserted therein spaced thereabove;

FIG. 2 is a perspective view of the jewelry pad of FIG. 1, with a jewelry item seated thereon;

FIG. 3 is a cross-sectional view of the jewelry pad of FIG. 1, taken along line 3—3 thereof;

FIG. 4 is a cross-sectional view of the jewelry pad of FIG. 1, taken along line 4—4 thereof;

FIG. 5 is a perspective view of a jewelry pad according to another embodiment of the present invention;

FIG. 6 is a cross-sectional view of a plug according to another embodiment of the present invention for use with the jewelry pad of FIG. 5;

FIG. 6A is a cross-sectional view of a plug similar to that of FIG. 6, but modified therefrom;

FIG. 6B is a perspective view of a portion of a plug similar to FIG. 6, but modified therefrom;

FIG. 6C is perspective view of a portion of a plug similar to FIG. 6, but modified therefrom;

FIG. 7 is a perspective view of the jewelry pad of FIG. 5, with the plug of FIG. 6 inserted therein;

FIG. 8 is a cross-sectional view of the jewelry pad of FIG. 7, taken along line 8—8 thereof;

FIG. 9 is a perspective view of the jewelry pad of FIG. 7, with a jewelry item seated thereon.

DETAILED DESCRIPTION OF THE PREFERRED EMBODIMENTS

Referring to the drawings in detail, and initially to FIGS. 1–4 thereof, a deformable and resilient jewelry pad 10*b* according to one embodiment of the present invention includes a substantially rectangular upper inclined wall 14*b* that extends upwardly and rearwardly from the upper edge of a front wall 16*b* thereof at an inclination of about 20° to a flat or ground surface. The angular orientation provides that the subsequently discussed recesses do not touch the flat surface when the pad is removed from the tray and placed on the flat surface, while also providing an improved view of the jewelry item. Inclined wall 14*b* can have a slightly convex bowed configuration. Triangular side walls 18*b* each having an upper inclined edge are connected with a respective side edge of inclined wall 14*b*, and a substantially rectangular rear wall 20*b* has its upper edge connected with the rear edge of inclined wall 14*b* and its opposite side edges connected to the rear edges of triangular side walls 18*b*. Rear wall 20*b* may be inclined rearwardly and downwardly at an inclination of, for example, about 15°. In addition, rear wall 20*b* may have a slightly concave bowed configuration. With this arrangement, the lower edges of front wall 16*b*, side walls 18*b* and rear wall 20*b*, lie in the same horizontal plane and support pad 10*b* on a flat surface.

Preferably, each pad 10*b* is made from a flexible plastic material that can be deformed but which retains its shape when the deformation force is removed. Alternatively, each pad 10*b* can be made of a rubber or any other suitable material. In any event, each pad 10*b* is made of a high memory material with a substantially thin, constant thickness throughout. Because pads 10*b* have a substantially constant thickness throughout, they are thin and therefore easily deformable, while reducing the amount of material that is used. Each pad 10*b* fits within a recess of a jewelry tray (not shown), as is well known, and is held therein.

Preferably, each pad 10*b* is formed as a single, unitary plastic molded part, although it is also possible to provide a fabric material or flocked layer thereon.

Specifically, unlike conventional jewelry pads, each pad 10*b* is formed in an injection molding operation, using pellets of an injection molding material, such as polypropylene, olefinic materials, polyurethane, and other synthetic rubber, plastic rubber or flexible materials. An example of such a material is one sold under the trademark KRATON. Thus, the pellets are placed in a conduit leading to a space between two mold halves. The pellets are heated to liquify the same, and the liquid is forced under pressure to a space between the two closed two mold halves to form the jewelry pad. Then, the mold is cooled, and the mold halves are separated, in order to remove the formed jewelry pad therefrom. The formation of jewelry pads by injection molding has not been performed prior to the present invention.

Injection molded rubbery pads 10*b* are flexible and do not lose memory. They fit securely into an undercut in the jewelry tray and never fall out, or become deformed like foam rubber pads.

"Memory" pads 10*b* are made of a soft, flexible material which contain flexible, rubbery mechanisms that hold a jewelry item or items thereon. The flexible pads are further aesthetically appealing. The "rubbery" mechanisms for holding the jewelry items thereon vary in design for each different type of jewelry item, but consistently hold jewelry items without the use of any devices, such as wires or pins and without special trays for each kind of jewelry item and without the requirement to remove the pad from the jewelry tray to insert or remove the jewelry items. These rubbery holding devices are molded right into the pad or molded into plugs which can be inserted into recesses in the pad. Once a plug is inserted it does not have to be removed to remove or replace a jewelry item.

Manufacturers will benefit from the ability to remove a pad and use it as an individual display which can be placed on the counter for the buyer to focus on an individual piece. Opening the bottom of the tray takes full advantage of the three-dimensional landscaping because the hollow pad above it allows room for a higher piece to stack below it. This also decreases the weight without at all taking from the strength of the tray for traveling.

Further, the use of injection molding to form the pads, enables the pads to be made transparent or translucent (hereinafter referred together as "at least translucent). In this manner, a light can be placed underneath or behind a jewelry pad to better illuminate the jewelry item held thereby.

Examples of specific holding mechanisms will now be described in detail.

As shown, one such pad 10b is formed with a generally rectangular parallelepiped recess 26b in upper inclined wall 14b, and spaced inwardly from peripheral edges of upper inclined wall 14b. Recess 26b forms one type of holding mechanism. In this regard, there is a rectangular cut-out 30b in upper inclined wall 14b to form the open upper end of recess 26b.

Recess 26b is formed by a bottom wall 32b, side walls 34b, a front wall 36b and a rear wall 48b. Specifically, parallel spaced apart side walls 34b are parallel to side walls 18b but spaced inwardly therefrom, with the rear edges of side walls 34b being connected to rear wall 48b and with the lower edges of side walls 34b being connected to side edges of bottom wall 32b. Front wall 36b extends down from upper inclined wall 14b at the front edge of cut-out 30b, with side edges of front wall 36b being connected to front edges of side walls 34b and with the bottom edge of front wall 36b being connected to the front edge of bottom wall 32b. Finally, rear wall 48b extends down from upper inclined wall 14b at the rear edge of cut-out 30b, with side edges of rear wall 48b being connected to rear edges of side walls 34b and with the bottom edge of rear wall 48b being connected to the rear edge of bottom wall 32b.

As one example of a jewelry item 38b that can be held therein, there is shown a flat, heart shaped pendant 40b having a short semi-circular bail 42b fixed to an upper end thereof. A finding 44b in the form of rabbit ears 46b is connected to bail 42b in a well known manner. In this case, rabbit ears 46b are slightly biased toward each other and inserted into recess 26b, and then released, whereupon rabbit ears 46b are biased outwardly by the natural spring action thereof, so that they are frictionally held by side walls 34b of recess 26b, with the depth of insertion being limited by bottom wall 32b and front wall 36b of recess 26b. Alternatively, it may be sufficient to merely place rabbit ears 46b within recess 26b without a friction fit thereof.

Since recess 26b is exposed at the upper end thereof, there is no need to provide any securing mechanism at the back of pad 10b or to puncture pad 10b in any manner to hold jewelry item 38b. Thus, it becomes relatively easy for a salesperson to remove jewelry item 38b from pad 10b to show the same, and to then reinsert jewelry item 38b back into recess 26b.

Referring now to FIGS. 5–9, a jewelry pad 10v according to another embodiment of the present invention will now be described in which elements corresponding to those of jewelry pad 10b are identified by the same reference numerals, but with the letter "v" added thereto, and a detailed description of the common elements will be omitted for the sake of brevity.

Jewelry pad 10v is identical to jewelry pad 10b, similar to recess 26b of FIG. 1 but with different dimensions. As a result, plugs 124v include a generally rectangular parallelepiped base 125v and of the same general dimensions as recesses 26v so as to snugly fit therein.

Further, each plug 124v has two L-shaped fingers 146v having one end integrally formed with the upper surface 130v of plug 124v and the other ends facing each other with a small gap 148v therebetween. Thus, the upper facing portions of L-shaped fingers 146v form a substantially continuous holder for jewelry item 38v which is identical to jewelry item 38b of FIG. 1. In this case, rabbit ears 46v are held by L-shaped fingers 146v. In the context of the present invention, reference to an L-shape in relation to fingers 146v is intended to encompass various modifications thereof, such as fingers having the general shape of a quarter circle, a quarter oval, various bent configurations and the like.

Specifically, opposing fingers 146v can be separated due to the deformable nature thereof, with rabbit ears 46v being inserted so that fingers 146v, due to the resilient nature thereof and after the biasing force thereon is removed, extend into rabbit ears 46v so as to removably secure rabbit ears 46v to jewelry pad 10v. Thus, rabbit ears 46v are removably held by fingers 146v.

Thus, with this embodiment, there is no need to provide any puncture of jewelry pad 10v or to provide a securing element for jewelry item 38v.

Of course, it will be appreciated that the various fingers need not be identical.

For example, as shown in FIG. 6A, plug 224v includes two L-shaped fingers 246v and 247v on a base 225v, with a small gap 248v between the free ends of fingers 246v and 247v, and with finger 246v being longer than finger 247v.

FIG. 6B shows a plug 824v which is a variation of plug 124v, but in which the L-shaped fingers 846v extending from base 825v have free ends with a complementary curvature that contact and mate with each other in an overlapping manner, but which can be separated from each other. Thus, in the unbiased position, there is no gap between the free ends of L-shaped fingers 846v.

FIG. 6C shows a plug 924v which is a variation of plug 824v, with the only difference being that the free ends of L-shaped fingers 946v are cut on a diagonal. The free ends of L-shaped fingers 946v contact and mate with each other, and can be separated from each other. Thus, in the unbiased position, there is no gap between the free ends of L-shaped fingers 946v.

Further, any of the holding means on the plugs of FIGS. 5–9 can be permanently affixed to or provided on the upper inclined surface of a jewelry pad, rather than be provided on a plug arrangement.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A jewelry pad comprising:

an upper wall having an upper exposed surface;

at least one supporting wall connected to the upper wall for supporting the upper wall on a horizontal surface such that the upper wall is at most only slightly inclined relative to the horizontal surface;

at least one pair of opposing first and second fingers extending upwardly from and formed integrally as a unitary member with said upper wall for holding a jewelry item thereon, each finger including a first portion extending upwardly from and integrally formed with the upper exposed surface and a second portion which is connected to the first portion so as to extend substantially transversely therefrom in spaced relation from the upper exposed surface, with the second portions being substantially co-linear and extending toward each other and such that said second portions are arranged to retain a jewelry item with the jewelry item resting on the upper exposed surface of the upper wall; and each said finger is totally deformable and resilient so that it can be bent to permit access to the jewelry item retained thereby.

2. A jewelry pad according to claim 1, wherein said second portions of each said pair of opposing fingers have free ends which are at least substantially in contact with each other, and said free ends of both of said first and second fingers are movable away from each other to removably retain at least one said jewelry item thereon.

3. A jewelry pad according to claim 2, wherein said free end of said first finger has a first curved shape, and said free end of said second finger has a second curved shape which is complementary to said first curved shape and which interlocks therewith.

4. A jewelry pad according to claim 2, wherein said free end of said first finger has a first Z-lock surface, and said free end of said second finger has a second Z-lock surface which is complementary to said first Z-lock surface and which interlocks therewith.

5. A jewelry pad according to claim 2, wherein said free end of said first finger has a first angled surface, and said free end of said second finger has a second angled surface which is complementary to said first angled surface and which interlocks therewith.

6. A jewelry pad according to claim 1, wherein said second portions of each said pair of opposing fingers have free ends which are spaced from each other by a gap.

7. A jewelry pad according to claim 6, wherein said free end of said first finger has a first curved shape, and said free end of said second finger has a second curved shape which is complementary to said first curved shape.

8. A jewelry pad according to claim 6, wherein said free end of said first finger has a first Z-lock surface, and said free end of said second finger has a second Z-lock surface which is complementary to said first Z-lock surface.

9. A jewelry pad according to claim 6, wherein said free end of said first finger has a first angled surface, and said free end of said second finger has a second angled surface which is complementary to said first angled surface.

* * * * *